United States Patent [19]

Hoffman

[11] Patent Number: 4,986,926

[45] **Date of Patent: * Jan. 22, 1991**

[54] THICKENED ALKALI METAL HYPOCHLORITE COMPOSITIONS

[75] Inventor: Eugene Hoffman, Cincinnati, Ohio

[73] Assignee: The Drackett Company, Cincinnati, Ohio

[ * ] Notice: The portion of the term of this patent subsequent to May 9, 2006 has been disclaimed.

[21] Appl. No.: 336,566

[22] Filed: Apr. 10, 1989

[51] Int. Cl.[5] ..... C11D 7/54

[52] U.S. Cl. ..... 252/102; 252/103; 252/527; 252/531; 252/543; 252/550; 252/DIG. 14

[58] Field of Search ..... 252/98, 99, 102, 103, 252/186.25, 186.26, 173, 156, 531, 527, 543, 550

[56] References Cited

U.S. PATENT DOCUMENTS

| | | | |
|---|---|---|---|
| 3,684,722 | 8/1972 | Hyman et al. | 252/98 |
| 3,876,551 | 4/1975 | Laufer et al. | 252/103 |
| 3,985,668 | 10/1976 | Hartman | 252/99 |
| 4,005,027 | 1/1977 | Hartman | 252/95 |
| 4,282,109 | 8/1981 | Citrone et al. | 252/98 |
| 4,388,204 | 6/1983 | Dimond et al. | 252/98 |
| 4,399,050 | 8/1983 | Bentham et al. | 252/95 |

FOREIGN PATENT DOCUMENTS 137871 4/1985 European Pat. Off. .

*Primary Examiner*—Paul Lieberman
*Assistant Examiner*—John F. McNally
*Attorney, Agent, or Firm*—Charles J. Zeller

[57] ABSTRACT

A stable thickened bleach containing composition consisting of an aqueous alkali metal hypochlorite, an alkali metal hydroxide and a thickening additive composed of at least one of following classes of an anionic surfactants: (A) alkali metal salts of N-alkyl, N-acyl amino acids, and (B) alkali metal salts of alkyl sulfates and mixtures thereof. The thickened compositions have viscosities of at least 5 centipoises and remain stable without phase separation and maintain their viscosity and hypochlorite concentration for extended periods.

17 Claims, 1 Drawing Sheet

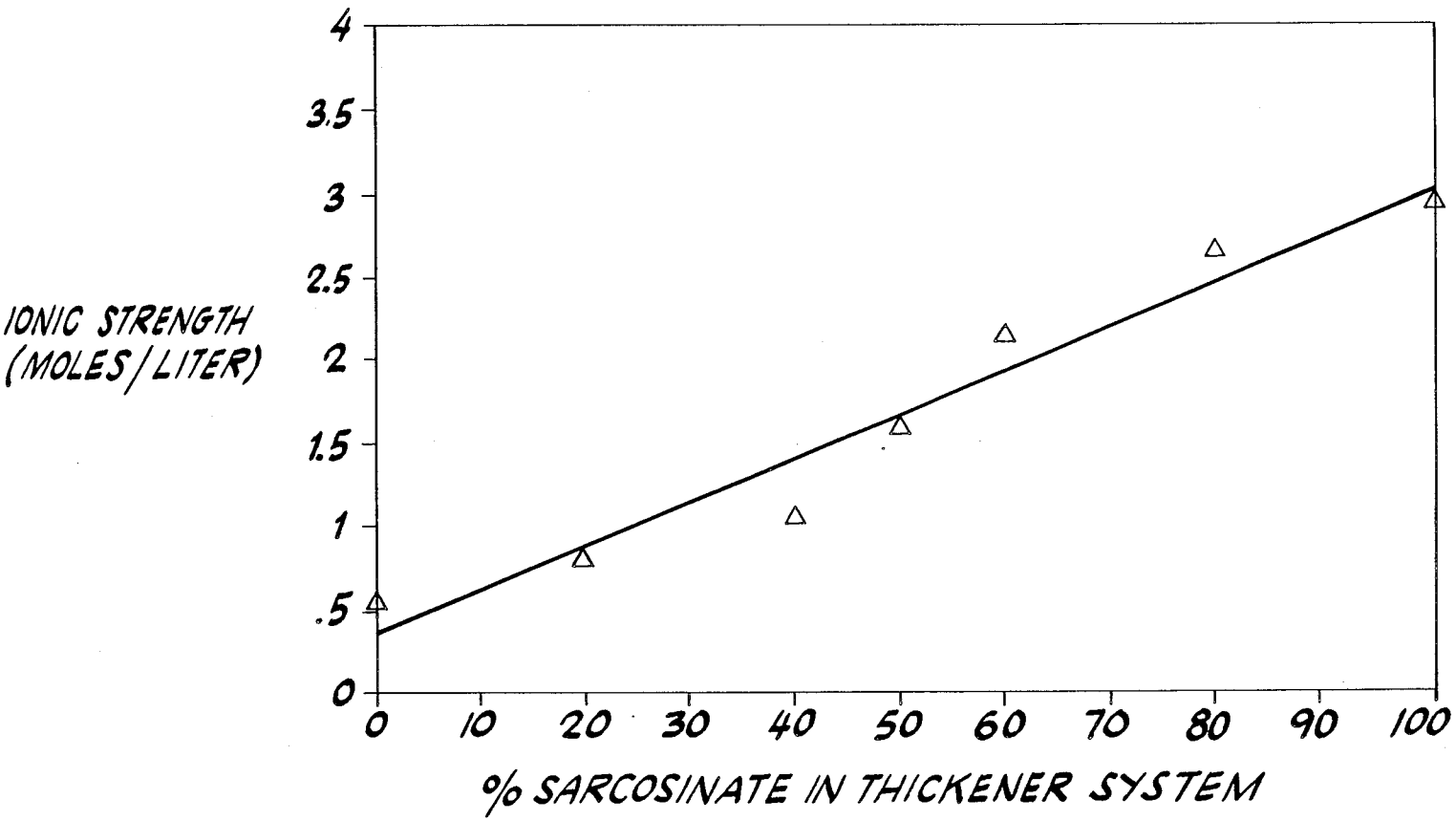
IONIC STRENGTH
(MOLES/LITER)
4
3.5
3
2.5
2
1.5
1
.5
0
0
10
20
30
40
50
60
70
80
90
100
% SARCOSINATE IN THICKENER SYSTEM

THICKENED ALKALI METAL HYPOCHLORITE COMPOSITIONS

This is a continuation-in-part of U.S. Ser. No. 69,466 filed July 2, 1987, now U.S. Pat. No. 4,828,748 which is a continuation of U.S. Ser. No. 815,832 filed Jan. 3, 1986, now abandoned.

BACKGROUND OF THE INVENTION

1. Field of the Invention

This invention relates to stable thickened alkali metal hypochlorite bleaching compositions. More particularly, this invention is concerned with thickened compositions of alkali metal hypochlorites suitable as a clogged drain opening composition, for general cleaning use, or for laundry bleaching applications, which compositions in terms of viscosity and hypochlorite content are stable for many months, even years.

2. Discussion of the Prior Art

Aqueous solutions of alkali metal hypochlorite bleaching agents are widely used in the bleaching of textile materials, as well as in general purpose cleaning and bleaching of hard surfaces, including dishes, glasses, metal surfaces, pots, pans, and the like. In addition, in view of the capability of the bleaching agents to attack protein fibers such as hair and food particles, which are often the cause of clogged drains in bathroom and kitchen sinks, aqueous compositions containing alkali metal hypochlorite are used as liquid drain opening compositions, usually in combination with alkali metal hydroxide Such a composition is disclosed in U.S. Pat. No. 3,697,431 to Summerfelt.

Summerfelt teaches that wetting agents, or surface active agents, in amounts of from 0.25% to up to about 1% by weight, may be utilized to increase the rate at which the drain opener penetrates the fatty substance which clogs the drain. In amounts in excess of 1%, deterioration of the hypochlorite is accelerated. Anionic monophosphate esters of an ethoxylated alcohol or the salts of a perfluoracid are the only hypochlorite and hydroxide compatible wetting agents mentioned.

U.S. Pat. No. 4,116,850 to Ruck discloses drain opener compositions which are aqueous solutions of a soluble metallic hydroxide, a chlorine releasing agent, and a catalyst which is a metallic chloride of a Group VI metal. There is no suggestion of adding any thickening agents in either the Summerfelt, Ruck or Jones et al. patents.

U.S. Pat. No. 4,388,204 to Dimond et al. discloses a ternary thickener system containing an alkali metal salt of an N-alkyl, N-fatty acyl amino acid such as sodium lauroyl sarcosinate, an alkali metal salt of an alkyl sulfate such as sodium lauryl sulfate and an alkali metal sulfate salt of an aliphatic ethoxylated alcohol such as sodium lauryl ether sulfate. The data indicates that binary systems of these components failed to provide either sufficient viscosity increase or stability, or both.

In addition, the data indicates that the ternary thickener system components had to be present in narrowly defined ranges. Hence, each of the three components recited in the Dimond patent and their concentrations were critical to obtaining the desired composition properties.

Thickened alkali metal hypochlorite bleaching and cleaning compositions have also been suggested in view of the advantage of thickened compositions in bleaching and/or cleaning vertical surfaces. An extensive review of the prior art appears in U.S. Pat. No. 4,388,204 to Dimond et al.

The use of various detergents or surface-active agents for providing a thickening function in alkali metal hypochlorite bleach containing compositions has also been suggested. For example, U.S. Pat. No. 4,388,204 mentions numerous patents. In addition, U.S. Pat. No. 4,337,163 to Schilp discloses a thickened bleach composition containing as the thickening agent a mixture of a first detergent, e.g., an amine oxide, and a second detergent selected from the group of alkali-metal salts of saturated $C_{8-18}$ fatty acids, alkali metal acylsarcosinates, alkali metal alkyltaurides, sugar esters, and alkali metal $C_{10-18}$ alkyl ether sulfates with 1 to 10 moles of ethylene oxide and/or propylene oxide.

U.S. Pat. No. 4,375,421 to Rubin, et al., discloses viscous compositions containing alkylamido betaines and certain water-soluble inorganic or organic salts. The inorganic salts suitable are the sulfates of groups IA, IIA, IIB, and IIIA metals, sulfates of non-metallic ions, and alkali metal carbonates. Organic salts include citrates, tartrates, succinates, and carboxymethyloxy succinates of metals from the same groups as stated above. Also included may be a micelle-forming anionic surfactant, for example, sodium lauryl sulfate, sodium alphaolefin sulfonate, ammonium lauryl sulfate, ammonium laurylethoxy sulfate, and the like.

Also, British Patent No. 1,548,379 discloses a thickened bleach composition comprising an aqueous solution of an alkali metal hypochlorite containing as the thickening agent a mixture of a sucrose surfactant and another hypochlorite soluble surfactant, for example, a quaternary ammonium compound, amine oxide, a betaine, or an alkanolamide.

British Patent Application No. 2,003,552A discloses that an amine oxide derived from a synthetic fatty acid of certain structure provide greater viscosity increase when incorporated into the composition disclosed in U.K. Patent No. 1,329,086, wherein sodium laurate was used as the second surfactant in the thickener system.

However, there is still a need for less expensive, simpler thickened aqueous alkali metal hypochlorite compositions of improved stability both with regard to the hypochlorite concentration and the viscosity of the composition, as well as with respect to phase stability, i.e., there should not be any phase separation of the composition during storage, even over extended periods.

A major difficulty in finding suitable organic thickeners; lies in the interaction between thickeners and hypochlorites. Because of this interaction, both viscosity and hypochlorite concentration decrease as a function of time. The rate of hypochlorite degradation that occurs as a result of the interaction with the thickener is typically much faster than the reduction in hypochlorite concentration taking place in commercial hypochlorite solutions according to the equation:

$$NaOCl = NaCl + \frac{1}{2}O_2$$

In many instances the compositions split into two phases. Moreover, many conventional thickeners are simply ineffective when used in aqueous hypochlorite compositions.

The problem of compatibility and stability between many classes of organic surface-active compounds and hypochlorite and the ineffectiveness of many conventional thickeners is well recognized and is discussed in several patents mentioned in U.S. Pat. No. 4,388,204. For example, Hynam, et al. U.S. Pat. No. 3,684,722 teaches the ineffectiveness of various polymeric thickeners, Veegum T, celluloses, silicones, water glass, bentonite, liquid paraffin, and sodium stearate (soap); Hartman U.S. Pat. Nos. 3,985,668 and 4,005,027 teaches that alkyl benzene sulfonates, olefin sulfonates, alkyl glyceryl ether sulfonates, alkyl ether sulfates and ethoxylated nonionic surfactants are to be avoided, while bleach stable surfactants that are especially resistant to hypochlorite oxidation fall into two main groups: water-soluble alkyl sulfates containing from about 8 to 18 carbon atoms in the alkyl group and water-soluble betaine surfactants.

Even among the classes of surfactants described in these patents as being compatible with and providing stable compositions with alkali metal hypochlorites, generally only a few of the many surfactants in each class are, in fact, stable enough for commercial applications.

Further extensive experiments and research to find hypochlorite compatible surfactants and especially surfactant mixtures revealed that only certain combinations of surfactant compounds and then only in certain critical proportions were capable of providing stable thickened hypochlorite bleaching compositions.

Accordingly, it is a object of the invention to provide stable thickened alkali metal hypochlorite compositions.

It is another object of the invention to provide a thickening additive composition which can be used to increase the viscosity of alkali metal hypochlorite compositions.

It is still another object of the invention to provide a thickened alkali metal hypochlorite composition for general purpose cleaning and laundry use, and for unclogging clogged drains, which is not expensive to produce and which remains stable for extended periods of time with regard to both product viscosity and hypochlorite ion concentration, as well as to phase stability.

SUMMARY OF THE INVENTION

These and other objects of the invention, which will become more apparent from the detailed description that follows, are accomplished by a thickening additive composition capable of stably thickening an aqueous solution of an alkali metal hypochlorite, wherein the thickening additive composition is composed of at least one compound selected from one or both of the following two classes of surface active anionic surfactant compounds:

(A) alkali metal salts of N-alkyl, N-fatty acyl amino acids; and (B) alkali metal salts of alkyl sulfates;

with the amounts and the ratio of A to B being dependent upon the concentration of inorganic ions in the bulk of the solution and the desired viscosity of the composition.

Most typically, the thickening additive composition is a mixture or blend of the (A) and (B) surfactant components, optionally as a dry, powdery mixture, but preferably as an aqueous solution or emulsion of the (A) and (B) surfactant components. In the latter case, the concentration of thickening additives (A) and (B) in the aqueous solution or emulsion conveniently are in the range of from about 5% to about 50% b weight of the total solution or emulsion.

In another aspect, the present invention provides a shelf-stable thickened aqueous liquid alkali metal hypochlorite bleaching composition which is stably thickened by adding to the aqueous solution of the alkali metal hypochlorite an amount of the thickening additive composition that provides a bleach composition viscosity of at least 5 centipoises, the bleaching composition having a half-life of the alkali metal hypochlorite concentration of about three months, and a phase stability of about three months.

The bleaching composition may also preferably include the usual amounts of such conventional bleaching composition ingredients as alkali metal hydroxide for its capability to attack proteins and to adjust the pH, an alkali metal silicate for its ability to protect against corrosion of metal surfaces and other optional adjuvants, such as, for example, perfumes, coloring agents, etc.

Generally, the thickened aqueous hypochlorite bleaching composition includes (a) from about 0.5 to about 12% of the alkali metal hypochlorite, (b) from about 0 to about 10% by weight of an alkali metal hydroxide, (c) from about 0 to about 5% by weight of an alkali metal silicate, (d) an effective thickening amount of the thickening additive composition, generally from about 0.1% to about 10%, and water.

The thickening additive (d) is composed of:

(A) from about 0 to about 100% by weight of the total thickening additive of at least one alkali metal salt of an N-alkyl, N-fatty acyl amino acid, and (B) from about 0 to about 100% by weight of the total thickening additive of at least one alkali metal salt of an alkyl sulfate; the proportions of components (A) and (B) being selected in such manner as to provide a stable thickened bleach composition at the ionic strength of the final bleach composition.

It has been found that the ionic strength of the thickened bleach composition of the present invention is a critical parameter in obtaining stable bleach compositions incorporating the thickener additive of the present invention, and that the proportions of components (A) and (B) are critically affected thereby, as hereinafter described.

The thickened bleach composition has a viscosity of at least about 5 centipoises (cps). General purpose cleaning and laundry care products typically have viscosities less than 5,000 cps, preferably from about 25 to about 400 ops, and most preferably from about 25 to about 250 cps, a half-life of the alkali metal hypochlorite concentration of about three months, a phase stability of about three months, and both preferably six months.

The present invention also provides a composition and method for chemically unclogging clogged drains, by contacting the clog with an effective amount, which will depend upon the severity of the clog, of the drain opener composition of the invention, for a sufficient time to effectively dissolve the clog. When the clog is sufficiently dissolved, water will be able to flow freely through the drain. The method may be used, for example, for clearing drains in bathrooms, kitchens, utility rooms, laundry rooms, etc., in both private and commercial establishments.

When the clog is located in a lateral section of pipe, the drain opener composition is thickened to a viscosity in the range of from about 25 cps to about 150 cps, preferably from about 30 cps to 100 cps; for clogs located in a vertical section of pipe the viscosity may be as high as about 400 cps, preferably from about 150 to 250 cps and most preferably from about 200 to 225 cps.

BRIEF DESCRIPTION OF THE DRAWING

FIG. 1 of the drawing illustrates the critical relationship between ionic strength and thickener additive composition in accordance with this invention.

DETAILED DESCRIPTION OF THE INVENTION

Thickened aqueous liquid hypochlorite bleaching compositions, including general purpose bleaching and cleaning compositions, as well as drain opener compositions, have several advantages over the corresponding non-thickened compositions. The most important of these advantages involves the ease in treating vertical or inclined surfaces due to the slower run-off of the thickened composition. Consumer appeal may also be heightened for thickened products.

However, to assure customer satisfaction, especially at the level of the home consumer and other non-industrial type applications, it is important that the stability of the thickened products be sufficiently high that the product can remain on the shelf in the store and in the home for extended periods without undergoing degradation of product characteristics.

For thickened aqueous liquid hypochlorite bleaching compositions, the most important characteristics which need to be stabilized against degradation over prolonged storage periods include the visual appearance, e.g., phase stability; the concentration of the active hypochlorite ion concentration, and the product viscosity.

Regarding phase stability, the product should remain homogeneous without breaking down into separate phases and without precipitation of any product components. In the present invention, the product is considered to have adequate phase stability if it does not separate into different phases when stored at temperatures within the range of from about 60° to about 90° F. for about three months, preferably about six months.

Regarding the hypochlorite ion concentration, the product is considered to be adequately stable if the concentration of the hypochlorite compound at the end of about three months is at least 50% of the initial concentration of the hypochlorite compound. In the present invention, when this criteria is satisfied, the product is said to have a half-life of its hypochlorite concentration of three months.

Regarding the viscosity of the thickened liquid aqueous alkali metal hypochlorite bleaching compositions, it is important that the viscosity should remain within a predetermined range which will depend on the intended use of the composition over the anticipated life of the product, generally for about three months, but preferably for about six months. For thickened drain opener compositions, the viscosity should be within the range of from about 25 to about 150 cps, especially from about 30 cps to about 100 cps, when the product is intended for use with drains having a clog located in a lateral section of pipe; and a preferred range of from about 150 to about 250 cps, most preferably from about 200 to about 225 cps, when the product is intended for use with drains having a clog located in a vertical pipe. These viscosity ranges, especially those given for lateral clogs, are somewhat dependent on the hypochlorite concentration but are expected to hold true for the concentration ranges described below.

For general purpose cleaning and bleaching compositions, viscosities in the range of from at least about 5 to less than about 5,000 cps, preferably from about 25 to about 400 cps, most preferably from about 25 to about 250 cps, are usually satisfactory.

To clean hard, vertical surfaces, such as tile walls and the like, a more viscous product, above 400 cps, may be desired. The compositions may even be employed at viscosities between 5,000 and 13,000 cps. At such viscosities, the composition will generally be in a gel or paste form and can be easily applied.

In the present application, viscosity is measured at 20° C. using a Brookfield Model LVT viscosimeter unless otherwise indicated.

As described in U.S. Pat. No. 4,388,204, extensive research to find suitable thickening additives for thickening aqueous solutions of alkali metal hypochlorite, especially sodium hypochlorite, included investigation of many different one-, two- and three- component systems of several different classes of surface active agents. Each of these systems was tested for its thickening effect as well as for its phase stability, hypochlorite concentration stability, and viscosity stability. As is shown in U.S. Pat. No. 4,388,204, none of the one- or two-component prior art surfactant additive systems was satisfactory with regard to all of these criteria, while among the three-component additive systems the overall best effects were provided by the mixed anionic surfactant compositions which are composed of the three-component thickening additive mixture of anionic surfactants (A), (B) and (C).

The thickening additive composition according to this invention is capable of stably thickening an aqueous solution of alkali metal hypochlorite, which may also include an alkali metal silicate and/or other optional adjuvants such as coloring agents, perfumes, etc. Because the thickening additive is a mixture of two different classes of anionic surfactants, the thickening additive may also exhibit a general cleaning and surface active function in the thickened bleach compositions of the invention.

The thickening additive composition is composed of (A) an alkali metal sulfate salt of an N-alkyl, N-fatty acyl amino acid, (B) an alkali metal salt of alkyl sulfate, and mixtures thereof, the proportions of components (A) and (B) being selected in such manner and with respect to the ionic strength of the final bleach composition as to provide a stably thickened bleach composition. Components (A) and (B) are well known surface active compounds or surfactants. It is important to use the alkali metal salts of these compounds because they are soluble in aqueous systems whereas, for example, the alkaline earth metal salts are generally insoluble or only slightly soluble in aqueous systems. The alkali metal is preferably sodium, potassium, or lithium, especially preferably sodium or potassium.

One or more of the surfactant components (A) and (B) may be readily commercially available in an aqueous solution or emulsion, and the components can be used in this form, which is the preferred embodiment. However, it is also within the score of the invention to simply mix each of components (A), and (B) in the form of dry powders. Other additives, i.e., additives which will not adversely affect the ability of the thickening additive to stably thicken aqueous solutions of alkali metal hypochlorite according to the above described criteria of phase stability, thickening ability and hypochlorite concentration, can be included in the bleach composition or in the thickener additive composition. For example, suitable additives may include one or more of coloring agents such as dyes, and/or pigments, perfumes, and the like.

The component (A) alkali metal salts are acid salts derived from the reaction of (a) N-alkyl substituted amino acids of the formula:

$$R_1—NH—CH_2—COOH \quad (I)$$

where $R_1$ is a linear or branched chain lower alkyl of from 1 to 4 carbon atoms, especially a methyl, for example, aminoacetic acids such as N-methylamino-acetic acid (i.e., N-methyl glycine or sarcosine), N-ethylaminoacetic acid, N-butylaminoacetic acid, etc., with (b) saturated natural or synthetic fatty acids having from 8 to 18 carbon atoms, especially from 10 to 14 carbon atoms, e.g., lauric acid, and the like.

The component (A) salts have the following formula:

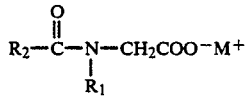

(II)

where M and $R_1$ are as defined above and $R_2$ represents a hydrocarbon chain of the fatty acyl group

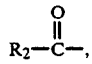

preferably a saturated hydrocarbon chain, having from 7 to 17 carbon atoms, especially from 9 to 13 carbon atoms.

Specific examples of the compounds of formula (II) as component (A) include, for example, sodium lauroyl sarcosinate, sodium myristoyl sarcosinate, sodium stearoyl sarcosinate, and the like, and the corresponding potassium and lithium salts.

These compounds can be used singly or as mixtures of two or more. These compounds should be essentially free of any undesired impurities or unreacted materials that may deleteriously affect the properties of the final bleach product composition. However, if there are any such impurities, or unreacted materials or intermediates, by-products, etc., the total amount of these unwanted ingredients is preferably less than about 1.7%, especially preferably less than about 1.0%, by weight on an anhydrous basis.

Particularly good results have been obtained with Hamposyl L-30 (a product of W. R. Grace & Co. —30% aqueous solution of sodium lauroyl sarcosinate). Similar aqueous solutions of sodium cocoyl sarcosinate and sodium myristoyl sarcosinate are also available from W. R. Grace & Co. under the trademarks Hamposyl C-30 and Hamposyl M-30, respectively Sarkosyl NL-30 (a product of the Geigy Chemical Corporation), Medialan KA (a product of the American Hoechst Corporation), and Maprosil 30 (a product of the Onyx Chemical Company), are other examples of sarcosinate anionic surfactants which can be used as component (A).

The component (A) anionic surfactant is present in the thickening additive in a weight percent amount within the range of from about 0% to about 100%. The actual concentration of component (A) in the thickening additive is dependent on the ionic strength of the total bleach formulation and the viscosity and shelf life required for the thickened hypochlorite composition. Concentration of (A) is also affected by the particular compound being used as component (A) and the selection of the other surfactant compounds of the thickening additive.

The component (B) alkali metal salts of alkyl sulfates are compounds of the general formula:

$$R_3SO_4^-M^+ \quad (III)$$

where $R_3$ represents a linear or branched alkyl group of from about 8 to about 18 carbon atoms, preferably from about 10 to about 14 carbon atoms, and M is as previously defined.

Examples of compound of formula (III) include sodium, potassium and lithium salts of decyl sulfate, lauryl sulfate, myristyl sulfate, dodecyl sulfate, and the like. These compounds may be used individually or as mixtures of two or more.

Once again, it is important to select the component (B) anionic surfactant to be substantially free from impurities, salts, intermediates and by-products that may deleteriously affect the properties of the final bleach product composition. Accordingly, the amount of any such impurities should be preferably less than about 3.0%, especially preferably less than about 1.5%, by weight on an anhydrous basis.

Particularly good results have been obtained using Sipex NCL, a trademarked product of Alcolac, Inc., Maryland, a high purity aqueous solution—about 29 wt. percent solids—of sodium lauryl sulfate, which is substantially free from sodium chloride and contains about 0.2% sodium sulfate. Particularly good results were also obtained with Stepanol WAC, a trademarked product of the Stepan Company, Northfield, Ill., an aqueous solution containing about 29 wt. percent sodium lauryl sulfate with a maximum of 0.1% sodium chloride and 1.0% sodium sulfate. High purity sodium lauryl sulfate powder is also available as Maprofix 563 (a trademarked product of Onyx Chemical Company). Other suitable commercially available alkyl sulfate anionic surfactants include Stepanol WA-100 (a product of the Stepan Company), and Conco Sulfate WR (a product of the Continental Chemical Company).

The component (B) anionic surfactant is present in the thickening additive in an amount within the range of from 0% to 100%. The actual concentration of component (B) in the thickening additive is dependent on the ionic strength of the total bleach formulation and the viscosity and shelf life required for the thickened hypochlorite composition. The concentration of (B) is also affected by the other surfactant component of the thickening additive.

In thickeners comprised of components (A) and (B), levels in a premix of thickening additives may be as high as 50% weight percent on an active basis.

The thickening additive composition can be prepared by simply mixing, with good stirring, or shear blending, the two components simultaneously or in any order. Each of the anionic surfactant components may be added to the other anionic component as their aqueous solutions or emulsions, although it is also possible to add either of components (A) and (B) as powders to an aqueous solution or emulsion of the remaining component(s). It is also possible to blend the components (A) and (B), each in powder form. Optionally, if desired, this blended powdery thickening additive may be dissolved or emulsified in a quantity of water to form the mixed anionic surfactant composition before using the composition to thicken the aqueous hypochlorite solution. Mixing can be effected at room temperature, although generally temperatures in the range of from about 70° F. to about 190° F. can be used. The pressure during mixing can be atmospheric pressure, although higher or lower pressures can be used.

It has been unexpectedly found that a critical relationship exists in bleach compositions employing thickening additive compositions of the present invention between the ionic strength of the bleach composition and the composition of the thickening additive.

Ionic strength is a measure of the concentration of free ions in solution. The concept of ionic strength is used quite frequently in the field of physical chemistry when studying the behavior of ions in solution. Mathematically, ionic strength is approximated by $\mu=\frac{1}{2}\Sigma CiZi^2$ where Ci is the concentration of the individual ion and Zi is the valence of the ion.

The critical relationship between ionic strength and thickener additive composition is discussed below with reference to FIG. 1 which illustrates the relationship of ionic strength to the percent of component (A) in the thickening additive, for a constant level of thickening additive.

FIG. 1 clearly demonstrates the importance of having the proper blend of the thickening additive components, to yield the maximum viscosity available for a stable bleach composition of given ionic strength. The data used to prepare FIG. 1 is set forth in Table A. The compositions evaluated contained sodium hypochlorite and thickening additive composed of sodium lauroyl sarcosinate and sodium lauryl sulfate. The sodium hypochlorite used in preparing the compositions of Table A was a 16% (nominal) solution containing 0.2% sodium hydroxide, and the thickening additive concentration for each of the final compositions was 1.5% by weight on an active basis. In constructing the diagonal line of FIG. 1, the weight percent sodium lauroyl sarcosinate in the thickening additive composition was plotted versus the highest ionic strength of a stable bleach composition, of the compositions having the same sodium lauroyl sarcosinate concentration. For example, at 100% sodium lauroyl sarcosinate, the ionic strength of the 8.0% NaOCl composition was plotted, as represented by the triangular data point. The linear curve was then obtained by linear regression of the data points, yielding the equation $$\mu=0.0269x+0.3457$$

wherein $\mu$ is the ionic strength and x is the weight percent sodium lauroyl sarcosinate in the thickening system. It should be understood that stable systems may exist between the data plotted and the next highest ionic strength value within the runs having a constant sodium lauroyl sarcosinate composition, the latter being unstable.

Referring to FIG. 1, the diagonal line represents the dividing line between stable formulas and unstable formulas, and further represents the maximum viscosity available for a stable thickened bleach composition of given ionic strength incorporating a given thickening additive composition. Thickened bleach compositions of a given ionic strength which fall below the line (i.e., a higher sarcosinate concentration) will be stable, but will suffer a viscosity decrease. As an example, at an ionic strength of 1.0, a thickening additive composition consisting of 25% sodium lauroyl sarcosinate and 75% sodium lauryl sulfate will be stable and will exhibit maximum viscosity. At an ionic strength of 1.0, a thickened bleach containing in the thickening additive above 25% sodium lauroyl sarcosinate would also be stable, but will have a lower viscosity. A thickened bleach composition containing in the thickening additive less than 25% sodium lauroyl sarcosinate would, at an ionic strength of 1.0, fall above the line and would not be stable. Increasing ionic strength (by increasing, for example, $OCl^-$ concentration) would destabilize the bleach composition. Decreasing ionic strength would provide a stable bleach composition of lower viscosity. Consequently, the more distance between the dividing line and a composition point below the line, the lower the resulting viscosity will be assuming that total thickener system level and the thickener additive or the ionic strength of the bleach composition remain constant. In general, the amount of thickening additive used in the thickened bleach composition does not compromise stability within the stable region, as defined by the dividing line of FIG. 1. Consequently, at a given stable composition data point, i.e., at any point on or below the dividing line, the viscosity of the composition may be changed without phase separation by increasing or decreasing the level of thickening additive used. From the foregoing it is seen that at very low ionic strengths it is possible to thicken sodium hypochlorite solutions with sodium lauryl sulfate alone. At the high end of the ionic strength scale, sodium lauryl sarcosinate alone functions as a thickening additive.

TABLE A

| Nominal NaOCl Concentration | Thickener Composition % Sodium Lauryl Sulfate | Thickener Composition % Sodium Lauroyl Sarcosinate | Initial Ionic Strength (Moles/L) | Condition after 3 mos. Ambient T. |
|---|---|---|---|---|
| 0.5 | 0 | 100% | 0.13 | clear and uniform |
| 1.0 | 0 | " | 0.27 | " |
| 2.0 | 0 | " | 0.54 | " |
| 3.0 | 0 | " | 0.81 | " |
| 4.0 | 0 | " | 1.07 | " |
| 5.0 | 0 | " | 1.34 | " |
| 6.0 | 0 | " | 1.61 | " |
| 7.0 | 0 | " | 1.88 | " |
| 8.0 | 0 | " | 2.15 | " |
| 9.0 | 0 | " | 2.42 | uniform but cloudy |
| 10.0 | 0 | " | 2.69 | " |
| 11.0 | 0 | " | 2.96 | separated(1) |
| 12.0 | 0 | " | 3.22 | " |
| 0.5 | 20 | 80 | 0.13 | clear and uniform |
| 1.0 | " | " | 0.27 | " |
| 2.0 | " | " | 0.54 | " |
| 3.0 | " | " | 0.81 | " |
| 4.0 | " | " | 1.07 | " |
| 5.0 | " | " | 1.34 | " |
| 6.0 | " | " | 1 61 | " |
| 7.0 | " | " | 1.88 | " |
| 8.0 | " | " | 2.15 | " |
| 9.0 | " | " | 2.42 | " |
| 10.0 | " | " | 2.69 | " |
| 11.0 | " | " | 2.96 | separated |
| 12.0 | " | " | 3.22 | " |
| 0.5 | 40 | 60 | 0.13 | clear and uniform |
| 1.0 | " | " | 0.27 | " |
| 2.0 | " | " | 0.54 | " |
| 3.0 | " | " | 0.81 | " |
| 4.0 | " | " | 1.07 | " |
| 5.0 | " | " | 1.34 | " |
| 6.0 | " | " | 1.61 | " |
| 7.0 | " | " | 1.88 | " |
| 8.0 | " | " | 2.15 | " |
| 9.0 | " | " | 2.42 | separated |
| 10.0 | " | " | 2.69 | " |

TABLE A-continued

| Nominal NaOCl Concentration | Thickener Composition % Sodium Lauryl Sulfate | % Sodium Lauroyl Sarcosinate | Initial Ionic Strength (Moles/L) | Condition after 3 mos. Ambient T. |
|---|---|---|---|---|
| 11.0 | " | " | 2.96 | " |
| 12.0 | " | " | 3.22 | " |
| 0.5 | 50 | 50 | 0.13 | clear and uniform |
| 1.0 | " | " | 0.27 | " |
| 2.0 | " | " | 0.54 | " |
| 3.0 | " | " | 0.81 | " |
| 4.0 | " | " | 1.07 | " |
| 5.0 | 50 | 50 | 1.34 | clear and uniform |
| 6.0 | " | " | 1.61 | " |
| 7.0 | " | " | 1.88 | separated |
| 8.0 | " | " | 2.15 | " |
| 9.0 | " | " | 2.42 | " |
| 0.5 | 60 | 40 | 0.13 | clear and uniform |
| 1.0 | " | " | 0.27 | " |
| 2.0 | " | " | 0.54 | " |
| 3.0 | " | " | 0.81 | " |
| 4.0 | " | " | 1.07 | " |
| 5.0 | " | " | 1.34 | separated |
| 6.0 | " | " | 1.61 | " |
| 0.5 | 80 | 20 | 0.13 | clear and uniform |
| 1.0 | " | " | 0.27 | " |
| 2.0 | " | " | 0.54 | " |
| 3.0 | " | " | 0.81 | " |
| 4.0 | " | " | 1.07 | separated |
| 5.0 | " | " | 1.34 | " |
| 0.5 | 100 | 0 | 0.13 | clear and uniform |
| 1.0 | " | " | 0.27 | " |
| 2.0 | " | " | 0.54 | " |
| 3.0 | " | " | 0.81 | separated |
| 4.0 | " | " | 1.07 | " |

(1)Sample is very cloudy. Although no distinct phase separation was seen, this sample was predicted to probably separate in the next week.

The importance of the level of sodium lauroyl sarcosinate in the thickening additive is further demonstrated by the data in Table B. The data in Table B show that as ionic strength increases, the ratio of alkali metal salt of an alkyl sulfate (sodium lauryl sulfate) to the alkali metal salt of an N-alkyl, N-fatty acyl amino acid (sodium lauroyl sarcosinate) must decrease, to obtain stable bleach compositions at a constant thickening additive level. The table also demonstrates a general trend toward higher available viscosities as the ionic strength increases and the aforesaid ratio decreases, at a constant level of thickener in the bleach composition.

TABLE B

| Ionic Strength (M/L) | Ratio (1) | Surfactant by Wt. % | Surfactant Viscosity at 70° F. |
|---|---|---|---|
| 0.67 | (2) | 3.00 | 18.5 cps |
| 0.81 | 19.00 | " | separated |
| " | 15.67 | " | " |
| " | 13.28 | " | 45.5 cps |
| 1.08 | 5.66 | " | separated |
| " | 4.00 | " | " |
| " | 3.35 | " | " |
| " | 3.17 | " | " |
| " | 3.00 | " | " |
| " | 2.70 | " | " |
| " | 2.57 | " | 25.0 cps |
| " | 2.33 | " | 44.0 cps |
| 1.62 | 2.33 | " | separated |
| " | 1.85 | " | " |
| " | 1.50 | " | " |
| " | 1.32 | " | " |
| " | 1.22 | " | 451.7 cps |
| " | 1.00 | " | 7.0 cps |
| 2.16 | 1.13 | " | separated |
| " | 1.00 | " | " |
| " | 0.89 | " | " |
| " | 0.85 | " | 1,600.0 cps |

TABLE B-continued

| Ionic Strength (M/L) | Ratio (1) | Surfactant by Wt. % | Surfactant Viscosity at 70° F. |
|---|---|---|---|
| " | 0.82 | " | 1,625.0 cps |
| 2.70 | 1.00 | " | separated |
| " | 0.82 | " | " |
| " | 0.72 | " | " |
| " | 0.69 | " | " |
| " | 0.67 | " | 1,200 cps |
| 3.00 | (3) | " | 145 cps |

(1) Ratio of sodium lauryl sulfate to sodium lauroyl sarcosinate
(2) 100% sodium lauryl sulfate.
(3) 100% sodium lauroyl sarcosinate.

The total concentration of the thickening additive composed of anionic surfactant components (A) and (B) in an aqueous mixture of the mixed anionic surfactant composition is not particularly critical and can be chosen with regard to the viscosity requirements of the intended end product and the concentration requirements of the hypochlorite compound in the end product bleaching composition. For example, because the concentration of the alkali metal hypochlorite for a drain opening composition is preferably in the range of from about 3.0% to 6.0%, an aqueous solution of the thickening additives may provide enough water to dilute the starting unthickened aqueous hypochlorite solution to within the desired concentration. To obtain the desired concentration, water may also be added to dilute the aqueous alkali metal hypochlorite solution or the bleach composition concentrate at any time during manufacture. When other components such as sodium hydroxide, sodium silicate, etc., which may be included in the composition, are added as aqueous solutions, the amount of water added with these other components should also be taken into consideration.

When the mixed anionic surfactant composition is in the form of an aqueous solution or emulsion, the amount of the thickening additive should not be so great that the viscosity of the composition is too high to be handled conveniently when being mixed with the aqueous solution of the hypochlorite, for example, during pumping, pouring, mixing, etc. On the other hand, the concentration of thickening additive in solution should not be so low that addition of the mixed surfactant composition provides product bleach compositions of improper specification. Taking into consideration the amount of water provided by the other constituents, and the viscosity desired of the aqueous thickening additive composition for mixing purposes, thickening additive present in an aqueous solution or emulsion may be in the range of from about 5 to about 50% by weight, although these ranges are not critical. Preferably, the range is from about 10 to about 40% by weight, most preferably from about 15 to about 30%. Commercially available solutions of individual components (A) and (B) are typically in the range of from about 25 to 40% by weight.

A particularly useful thickened liquid composition, according to the invention for clearing clogged drains, is as follows:

| | WEIGHT PERCENT Broad | Preferred |
|---|---|---|
| alkali metal hypochlorite | 1.0–10.0 | 3.0–6.0 |
| alkali metal hydroxide | 0.5–10.0 | 1.0–6.0 |
| alkali metal silicate | 0.0–5.0 | 1.0–2.5 |
| thickening additive | 0.1–6.0 | 0.5–4.7 |

-continued

| | WEIGHT PERCENT | |
|---|---|---|
| | Broad | Preferred |
| water | q.s. 100 | q.s. 100 |

Most preferably the range for alkali metal hydroxide is between about 1.0 to about 2.5% by weight, and for the thickening additive between about 0.5 to about 3.0% by weight. The proportions of anionic surfactant components (A) and (B) in the thickening additive component of the stable hypochlorite compositions are selected to provide a product viscosity in the range of from about 25 to about 150 cps, preferably from about 30 to 100 cps, when the composition is intended for clearing clogs in lateral pipe sections, or in the preferred range of from about the composition is intended 150 to about 250 cps when for clearing clogs in vertical pipe sections, and to provide a half-life of the hypochlorite concentration of about three months, preferably six months, as measured by a percent hypochlorite loss per day, calculated by the following equation:

Average % MOCl Loss/Day =

$$\left(\frac{\%\ MOCl_I - \%\ MOCl_F}{\%\ MOCl_I}\right)\left(\frac{100}{\text{Number of days}}\right)$$

where M=alkali metal and $MOCl_I$=initial concentration and $MOCl_F$=final concentration. Using the formula, an average loss per day of about 0.28% corresponds to a six month half life, while a value of 0.14% approximately corresponds to a one year half life of the hypochlorite concentration. Furthermore, the total thickening additive concentration in the hypochlorite composition and the proportions of components A) and (B) in the thickening additive, are chosen to provide a product shelf life of about three months as measured by the phase stability of the product stored at temperatures within the range of from about 60° F. to about 90° F., i.e., the hypochlorite composition will not separate into different phases when stored at room temperature.

These criteria of viscosity and phase stability, can be achieved by any number of combinations of components (A) and (B), the usable weight percentages of components (A) and (B) in the thickener additive being determined by the ionic strength of the final bleach formulation, as previously described.

The alkali metal hypochlorite component is generally available as aqueous solutions containing anywhere from about 10 to 20% available chlorine, preferably about 12 to 18% available chlorine. The alkali metal is preferably sodium, but may also be potassium or lithium, or mixtures thereof. As made, hypochlorite solutions obtained commercially contain an equimolar concentration of the corresponding alkali chloride. With time the concentration of the alkali chloride increases according to:

$$MOCl \rightleftharpoons MCl + \tfrac{1}{2}O_2$$

The amount of alkali metal hypochlorite in the product thickened bleach composition can be in the range of from about 0.5 to about 12, preferably from about 1.0 to 10, and most preferably about 3 to 6% by weight based on the total composition and depending on the intended use. As pointed out above, the drain opening compositions preferably contain from about 3.0 to 6.0% by weight of the alkali metal hypochlorite.

An alkali metal hydroxide may also be present in the thickened bleach compositions of the invention in amounts up to about 10% by weight, preferably from about 0.5 to 1.8% by weight, and especially preferably about 1.21% by weight. The preferred hydroxides are potassium hydroxide and sodium hydroxide. Mixtures of the alkali metal hydroxides can be used.

When the compositions are intended for use in applications in which they will come into contact with metals, for example, liquid drain opener compositions, an alkali metal silicate corrosion inhibitor up to about 5% by weight may also be present. Suitable amounts of the silicate are within the range of from about 0.3 to 5% by weight, preferably 0.3 to 2.5% by weight. Sodium silicate is preferred although potassium silicate can also be used.

Other optional adjuvants which are inert to the hypochlorite bleaching agent and other ingredients of the thickened bleach compositions of the invention can be used in small amounts, so long as they do not interfere with the stability of the compositions, for instance, perfumes and coloring agents in amounts up to about 1.0% by weight, preferably up to about 0.50% by weight, can be added to the compositions. Scouring agents and other bleaching agents, etc., can also be included, preferably in amounts of less than about 2.5% by weight, most preferably in amounts of less than about 1.5% by weight.

The thickened bleach compositions include the aqueous alkali metal hypochlorite solution and thickening additive as essential components. In addition to its thickening function, the thickening additive may also provide a detergent or cleaning function.

To prepare the thickened bleach composition, the aqueous hypochlorite solution can be simply mixed, with sufficient stirring, with the previously prepared thickening additive composed of the aqueous mixture of the anionic surfactants (A) and (B). Any other ingredients such as the alkali metal hydroxide, alkali metal silicate, or other optional adjuvants can first be added to the aqueous solution of the alkali metal hypochlorite and stirred to form a homogeneous mixture prior to mixing with the thickening additive.

It has been found that a particularly efficient method for mixing the thickening additive with the premixed aqueous solution of the alkali metal hypochlorite and any other ingredients is to simultaneously pump the thickening additive preparation and the premixed aqueous hypochlorite preparation through a static mixer. It has also been found that the alkyl sulfate tends to be difficult to disperse if added to the hypochlorite solution first. It is advantageous, therefore, to prepare an aqueous premix of the thickening additives, which may be added to the hypochlorite solution (or vice versa) in either a batch or continuous mixing process.

The invention will now be illustrated by the following representative, non-limiting examples of specific embodiments of the thickened bleach compositions according to the invention as well as by several comparative examples. In the following examples, all "parts" and "percentages" are on a "by weight" basis, unless otherwise indicated. All viscosity measurements are made at 20° C.

EXAMPLE 1

Aqueous thickening additives containing 6% sodium lauryl sulfate and proportionate amounts of sodium lauryl sarcosinate (both on a dry basis) as set forth in Table I were prepared using the following:

Hamposyl L-30[1]

Equex SP[2]

(1) sodium lauroyl sarcosinate—30% aqueous solution (a product of W. R. Grace & Co.)

(2) sodium lauryl sulfate—30% aqueous solution, (a product of Proctor & Gamble Company)

Five parts of the resulting thickening additives were added to 95 parts of an aqueous sodium hypochlorite composition. The experimental thickened bleach compositions included 1.11% sodium silicate and 1.21% sodium hydroxide, and had initial hypochlorite concentrations as reported in Table I. Over time the hypochlorite ion concentration decreased as noted. The ratios of sodium lauroyl sarcosinate to sodium lauryl sulfate were varied as set forth in Table I with the results as indicated.

TABLE I

| Sample | Ratio | Initial % NaOCl | Initial Viscosity | Final % NaOCl | Final Viscosity | NaOCl Loss/day |
|---|---|---|---|---|---|---|
| A | 1:1.429 | 5.38 | 20 cps | 3.39 | 19 cps | .09% |
| B | 1:1 | 5.34 | 13 cps | 3.38 | 15 cps | .09% |
| C | 1:1.250 | 5.44 | 17 cps | 3.37 | 15 cps | .09% |
| D | 1:1.111 | 5.58 | 13 cps | 3.33 | 15 cps | .10% |

In the compositions above, and in the examples that follow, it is to be understood that the bleach compositions contain an equimolar concentration of NaCl, as well as a small amount of NaOH. Sodium hydroxide in a 50% solution was added to bring the overall hydroxide concentration to the values noted. The sodium silicate is a mixture of $SiO_2$ and $Na_2O$ in the ratio 3.22:1 in about a 40% solution. The results shown above are based on fourteen month storage studies.

EXAMPLE 2

A thickened bleach composition was prepared as above wherein the ratio of sodium lauroyl sarcosinate to sodium lauryl sulfate was maintained constant at 1:1.25 and the level of thickening additive increased as indicated. The thick bleach contained 1.11% sodium silicate and 1.21% sodium hydroxide and the hypochlorite concentrations are noted below. Table II shows the effect of increasing the level of thickening additive on viscosity and NaOCl stability.

TABLE II

| Sample | % Active Thickener | Initial % NaOCl | Initial Viscosity | Final % NaOCl | Final Viscosity |
|---|---|---|---|---|---|
| E | 0.54 | 6.07 | 25 cps | 3.60 | 22.5 cps |
| F | 0.81 | 6.02 | 60 cps | 3.54 | 42.5 cps |
| G | 1.08 | 6.08 | 137 cps | 3.44 | 115.0 cps |

The results shown above are based upon five and one half months storage studies.

EXAMPLE 3

The following samples set forth in Table III demonstrate the effect of increased levels of the thickening additive on viscosity of the thickened bleach composition.

TABLE III

| Sample[1] | % Active Thickener[2] | Initial % NaOCl | Viscosity |
|---|---|---|---|
| H | 1.899 | 4.79 | 452 cps |
| I | 3.798 | 4.88 | 2,940 cps |
| J | 5.697 | 4.82 | 5,600 cps |
| K | 8.550 | 4.82 | 13,000 cps |

[1]Bleach premix comprised 52.52 parts of final thickened bleach composition having the NaOCl concentrations specified. Final bleach composition further contained 1.11% sodium silicate and 1.21% sodium hydroxide, on an active basis. Thickener premix provided as an aqueous solution such that it represents 48.58 parts of final bleach composition.

[2]sodium lauryl sodium/sulfate lauroyl sarcosinate ratio: 1:1.11.

The compositions of the present invention may optionally contain one or more surfactants that are not included in the compositions as part of the thickening additive and which do not materially raise the viscosity of the thickened bleach compositions not containing said one or more surfactants. The said one or more surfactants may be anionic, nonionic or amphoteric, and are typically present in an amount of from about 0.1 to about 15% by weight of the composition, with the proviso that alkali metal sulfate salts of ethoxylated aliphatic alcohols included in said one or more surfactants comprise less than about 2.5% by weight, based on the total weight of component (A), component (B) and said alkali metal sulfate salts of ethoxylated aliphatic alcohols. Preferably, said one or more surfactants are included in an amount of from about 0.1 to about 5%, most preferably from 0.1 to about 2%, by weight of the composition. Anionic and nonionic surfactants are especially preferred.

Broadly, the anionic surfactants are water-soluble alkyl or alkylaryl compounds, the alkyl having from about 8 to about 22 carbons, including generally a sulfate or sulfonate substituent group that has been base-neutralized, typically to provide an alkali metal, e.g., sodium or potassium, or an ammonium anion, including, for example: (1) alkyl sulfonates and alkylaryl sulfates and sulfonates having preferably 10 to 18 carbons in the alkyl group, e.g., Bioterge PAS-85 and sodium lauryl sulfonate and sodium dodecylbenzene sulfonate; (2) alphaolefin sulfonates preferably having from about 10 to 18 carbons in the olefin, e.g., sodium $C_{14-16}$ olefin sulfonate, (3) sulfated and sulfonated monoglycerides, especially those derived from coconut oil fatty acids; (4) sulfate and sulfonate esters of (a) ethoxylated fatty alcohols having 1–10 mols ethylene oxide, e.g., sodium polyoxyethylene (7 mols EO) lauryl ether sulfate and Avanel S-70, and (b) ethoxylated alkyl phenols having 10 mols ethylene oxide and 8 to 12 carbons in the alkyl, e.g., ammonium polyoxyethylene (4 mols EO) nonyl phenol ether sulfate; (5) baseneutralized esters of fatty acids and isethionic acid, e.g., sodium lauroyl isethionate; and (6) aliphatic phosphate esters such as Monafax 1214.

The nonionics include (1) fatty alcohol alkoxylates, especially the ethoxylates, wherein the alkyl group has from 8 to 22, preferably 12 to 18, carbons, and typically 6 to 15 mols alkoxide per molecule, e.g., coconut alcohol condensed with about 9 mols ethylene oxide; (2) fatty acid alkoxylates having from about 6 to about 15 mols alkoxylate, especially the ethoxylate; (3) alkylphenoxy alkoxylates, especially the ethoxylates, preferably the octyl or nonyl ethoxylates containing 6 to 12 carbons in the alkyl, and having about 5 to 25, preferably 5 to 15 mols alkylene oxide per molecule, e.g., nonyl phenol ethoxylated with about 9.5 mols ethylene oxide (Igepal CO-630), and (4) condensates of ethylene oxide with a hydrophobic base formed by condensation of propylene oxide with propylene glycol, e.g., nonionic surfactants of the Pluronic series manufactured by BASF Wyandotte.

What is claimed is:

1. A phase stable, thickened, aqueous bleach composition of given ionic strength having a shelf half-life of at least three months comprising an aqueous solution of an alkali metal hypochlorite, an alkali metal hydroxide, a thickening additive present in the composition in an amount effective to impart to the bleach composition a viscosity of at least about 25 cps., the thickening additive consisting correspondingly of (A) from 0 to 100% of an alkali metal salt of an N-alkyl, N-fatty acyl amino acid and (B) from 100 to 0% of an alkali metal salt of an alkyl sulfate, and from about 0.1 to about 15% of a surfactant other than components (A) and (B) of the thickening additive and which does not materially raise the viscosity of a composition not containing said surfactant, the surfactant being selected from the group consisting of anionic, nonionic and amphoteric surfactants, with the proviso that alkali metal sulfate salts of ethoxylated aliphatic alcohols included in the composition comprise less than about 2.5% by weight of the total weight of component (A), component (B) and said salt of the ethoxylated alcohol, the phase stability of the bleach composition being a function of the bleach composition ionic strength and the composition of the thickening additive such that at a given concentration of component (A) in the thickening additive a phase stable bleach composition is obtained at a bleach composition ionic strength equal to or less than a maximum value, the inclusion of less than said given concentration of component (A) in the thickening additive or an increase in ionic strength of the bleach composition above the maximum value generally causing the bleach composition of said given concentration of component (A) in the thickening additive and having said maximum ionic strength into two phases.

2. The composition of claim 1 wherein (A) is at least one compound of formula (II):

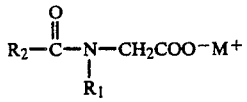

(II)

wherein $R_1$ is a linear or branched chain lower alkyl of from 1 to 4 carbon atoms, $R_2$ represents a hydrocarbon chain of the fatty acyl group

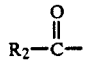

having from 7 to 17 carbon atoms, and M is an alkali metal cation and (B) is at least one compound of formula (III):

$$R_3SO_4M^+ \qquad (III)$$

wherein $R_3$ represents a linear or branched alkyl of from about 8 to 18 carbon atoms, and M is as previously defined.

3. The composition of claim 2 wherein the ionic strength of the composition is about equal to or less than the value predicted by the equation $$\mu = 0.0269x + 0.3457$$

wherein $\mu$ is the ionic strength of the composition and x is the present weight of (A) in the thickening additive.

4. The composition of claim 2 wherein the concentration of the thickening additive is in the range of from about 0.3 to about 10% by weight of the total composition.

5. The composition of claim 2 wherein $R_1$ is methyl, $R_2$ is a saturated hydrocarbon chain of 9 to 13 carbon atoms, $R_3$ is a linear or branched alkyl of 10 to 14 carbons, and M is as previously defined.

6. The composition of claim 5 wherein (A) is sodium lauroyl sarcosinate, (B) is sodium lauryl sulfate, and the alkali metal hydroxide is sodium hydroxide.

7. The composition of claim 5 wherein the viscosity range is between about 25 cps. to about 5,000 cps.

8. The composition of claim 6 wherein the thickening additive is a mixture of (A) and (B).

9. The composition of claim 1 or 6 wherein the viscosity of said phase stable bleach composition of said given concentration of component (A) in the thickening additive and having said maximum ionic strength generally decreases with a reduction in ionic strength from said maximum value or with an increase in said given concentration of component (A) in the thickening additive, at a given effective amount of the thickening additive.

10. The composition of claim 9 wherein the surfactant is present in an amount of from about 0.1 to about 5% by weight of the composition.

11. A phase stable, thickened, aqueous bleach composition of given ionic strength having a shelf half-life of at least three months comprising (a) from about 0.5 to about 12% by weight of an alkali metal hypochlorite, (b) from about 0 to about 10% by weight of an alkali metal hydroxide, (c) from about 0 to about 5% by weight of an alkali metal silicate, (d) an amount of a thickening additive effective to impart to the bleach composition a viscosity of at least about 25 cps., the thickening additive consisting correspondingly of (A) from 0 to 100% of an alkali metal salt of an N-alkyl, N-fatty acyl amino acid and (B) from 100 to 0% of an alkali metal salt of an alkyl sulfate, and (e) from about 0.1 to about 15% of a surfactant other than components (A) and (B) of the thickening additive and which does not materially raise the viscosity of a composition not containing said surfactant, the surfactant being selected from the group consisting of anionic, nonionic and amphoteric surfactants, with the proviso that alkali metal sulfate salts of ethoxylated aliphatic alcohols included in the total weight of component (A), component (B) and said salt of the ethoxylated alcohol comprise less than about 2.5% by weight of the composition, the phase stability of the bleach composition being a function of the bleach composition ionic strength and the composition of the thickening additive such that at a given concentration of component (A) in the thickening additive a phase stable bleach composition is obtained at a bleach composition ionic strength equal to or less than a maximum value, the inclusion of less than said given concentration of component (A) in the thickening additive or an increase in ionic strength of the bleach composition above the maximum value generally causing the bleach composition of said given concentration of component (A) in the thickening additive and having said maximum ionic strength to separate into two phases.

12. The composition of claim 11 wherein the alkali metal hypochlorite (a) is from about 1 to about 10%; the alkali metal hydroxide (b) is from about 0.5 to about 10%, the thickening additive (d) is from about 0.1 to about 6% and is a mixture of (A) and (B), and the surfactant (e) is from about 0.1 to about 5%, said composition having a viscosity in the range of from about 25 cps to about 400 cps, a half-life of the alkali metal hypochlorite concentration of about three months, and a phase stability of about three months.

13. The composition of claim 12 wherein the ionic strength of the bleach composition is about equal to or less than the value predicted by the equation $$\mu = 0.0269x + 0.3457$$

wherein $\mu$ is the ionic strength of the composition and x is the percent weight of (A) in the thickening additive.

14. The composition of claim 13 wherein (A) is sodium lauroyl sarcosinate, (B) is sodium lauryl sulfate, and the alkali metal hydroxide is sodium hydroxide.

15. The composition of claim 12 wherein the alkali metal hypochlorite (a) is from about 1.5 to about 10%, the alkali metal hydroxide b) is from about 0.5 to about 7%, the alkali metal silicate (c) is from about 0 to about 3%, the thickening additive (d) is from about 0.5 to about 5%, and the surfactant is from about 0.1 to about 5%.

16. The composition of claim 11, wherein the viscosity is between about 25 and 5,000 cps.

17. The composition of claim 11 or 15 wherein the viscosity of said phase stable bleach composition of given concentration of component (A) in the thickening additive and having said maximum ionic strength generally decreases with a reduction in ionic strength from said maximum value or with an increase in said given concentration of component (A) in the thickening additive, at a given effective amount of the thickening additive.

* * * * *